United States Patent [19]

Hawener et al.

[11] Patent Number: 4,693,670

[45] Date of Patent: Sep. 15, 1987

[54] ADJUSTING DEVICE FOR AN AIRPLANE PROPULSION SYSTEM

[75] Inventors: Juergen Hawener, Stuttgart; Klaus Hain, Leonberg, both of Fed. Rep. of Germany

[73] Assignee: Dr. h.c.F. Porsche Aktiengesellschaft, Fed. Rep. of Germany

[21] Appl. No.: 824,281

[22] Filed: Jan. 30, 1986

[30] Foreign Application Priority Data

Feb. 6, 1985 [DE] Fed. Rep. of Germany ..... 3503951

[51] Int. Cl.[4] ..... B63H 3/10

[52] U.S. Cl. ..... 416/25; 416/27

[58] Field of Search ..... 416/25, 27; 74/471 R, 74/516, DIG. 2

[56] References Cited

U.S. PATENT DOCUMENTS

| | | | |
|---|---|---|---|
| 2,216,416 | 10/1940 | Mader | 416/27 |
| 2,242,314 | 5/1941 | Martin et al. | 416/25 |
| 2,545,205 | 3/1951 | Hill et al. | 416/25 |
| 2,664,958 | 1/1954 | Dancik | 416/25 |
| 2,740,255 | 4/1956 | Machlanski | 416/27 X |
| 3,129,768 | 4/1964 | Collins | 416/27 |
| 3,261,405 | 7/1966 | Andrews | 416/27 |
| 3,518,022 | 6/1970 | Adams | 416/27 |
| 3,551,069 | 12/1970 | Morris | 416/27 |
| 4,430,907 | 2/1984 | Ben-Porat | 74/516 |

FOREIGN PATENT DOCUMENTS

| | | | |
|---|---|---|---|
| 227809 | 1/1959 | Australia | 416/27 |
| 1079961 | 4/1960 | Fed. Rep. of Germany | 416/25 |
| 3306612 | 9/1984 | Fed. Rep. of Germany . | |
| 817981 | 9/1937 | France | 416/27 |
| 983519 | 6/1951 | France | 416/27 |
| 790560 | 2/1958 | United Kingdom | 416/25 |
| 911021 | 11/1962 | United Kingdom | 416/27 |

*Primary Examiner*—Everette A. Powell, Jr.

[57] ABSTRACT

An adjusting device is provided for an airplane propulsion system using the reciprocating piston combustion engine and a propeller, which adjusting device simultaneously adjusts the throttle valve and the propeller pitch of the propellers. The adjusting device is formed with a connecting rod and a carrier rod connected thereto. The connecting rod is provided as an adjusting cable whereby the cable core is under spring pretensioning in lower rotational speeds of the motor.

14 Claims, 4 Drawing Figures

ADJUSTING DEVICE FOR AN AIRPLANE PROPULSION SYSTEM

BACKGROUND AND SUMMARY OF THE INVENTION

The invention relates to an adjusting device for an airplane propulsion system of the type having a reciprocation piston combustion engine with an adjustable intake throttle valve and with a propeller pitch regulator.

Such an adjusting device is described in German Unexamined Published Patent Application (DE-OS) 33 06 612. This device serves, with a single control lever, to adjust the throttle valve of a piston cylinder motor and therewith the motor operation as well as the blade pitch of the propellers driven by the motor, respectively the effective propulsion force at the airplane. It is there provided, through pivoting of the control lever to continually completely open the throttle valve already in the lower rotational speeds of the motor and through further pivoting of the control lever with the help of a propeller regulator for the propeller pitch reduce the same from larger to smaller pitch in order that the motor rotational speed is increased from the range of 2300 revolutions per minute to 5000 revolutions per minute. In this rotational speed range the motor power output which is absorbed entirely by the propeller is adjusted exclusively through the rotational input to the propeller regulator. The control lever effects or works on the throttle valve with this control arrangement via several linkage connections and intermediate levers whereby the adjustment because of the unavoidable linkage play or tolerances can be achieved only somewhat imprecisely. Furthermore, this linkage mechanism has the disadvantage that the throttle valve goes to the closing position upon breakage of an intermediate member causing consequent idle running of the motor and an acute danger that the airplane might crash.

An objective of the invention is to provide an adjusting device of the above mentioned type with constructively simple means with the motor operation being precisely adjustable and also so that upon a breaking of an intermediate member the full motor operation and propulsion forces are provided to the airplane.

This objective is achieved according to preferred embodiments of the invention by providing an adjusting apparatus which includes a movable connecting rod linked to the throttle valve and movably guided in a relatively fixed rod casing, a throttle valve spring continuously biasing the connecting rod toward an open throttle position, a manually releasable blocking device for selectively blocking movement of the connecting rod with respect to the rod casing, and a carrying rod connected to the connecting rod for movement therewith and also connected at a control member of the propeller pitch regulator via the interposition of a further pitch regulator spring member.

When a connecting rod including a control knob operable by the airplane pilot is directly linked at a throttle valve lever and simultaneously a carrier rod is linked to the connecting rod for operating an adjusting lever for the propeller pitch of the propellers, there is permitted in a simple manner an exact and functionally certain adjustment of the motor operation and the torque of the propellers. Because an auxillary spring operates on the throttle lever in the opening direction, upon breaking of a member of the adjusting device, the throttle valve is fully opened and the motor performance is maintained.

In especially preferred embodiments of the invention a commercially available adjusting cable is used for the connecting rod, including a cable casing or housing surrounding and guiding longitudinal movement of a metallic cable core whereby the control knob operated by the pilot is connected with the cable core. Such adjusting cable is provided centrally of the control knob with a blocking knob by means of which the blocking of the cable core with respect to longitudinal displacement may be selectively disconnected.

In certain preferred embodiments, connecting pivot joints are arranged at the throttle valve lever and the adjusting lever for the propeller pitch so that the respective ends of the connecting rod and the carrier rod protrude through the respective connecting pivot joints. The ends of the cable core and the carrier rod are provided with abutment rings which are movable into abutment at the connecting pivot joints to effect respective pivotable movement of the adjusting lever and throttle valve lever.

Further objects, features, and advantages of the present invention will become more apparent from the following description when taken with the accompanying drawings which show, for purposes of illustration only, an embodiment/several embodiments in accordance with the present invention.

DETAILED DESCRIPTION OF THE DRAWINGS

Figure 1:
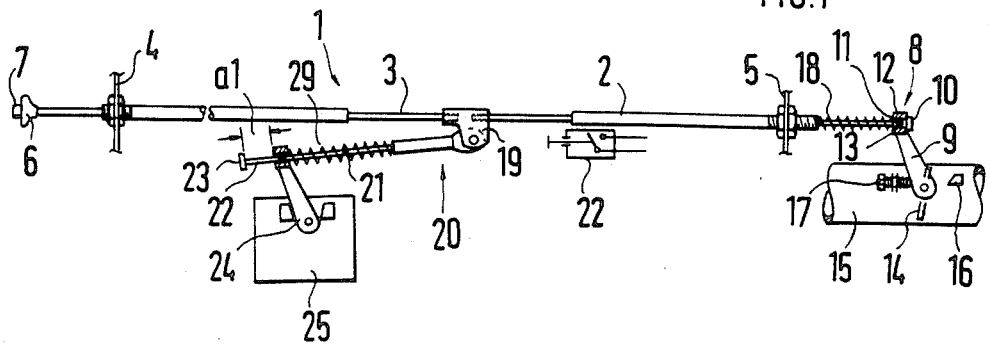
FIGS. 1–3 are schematic views which show an adjusting device constructed in accordance with a preferred embodiment of the invention in 3 respective different adjusted positions.
Figure 2:
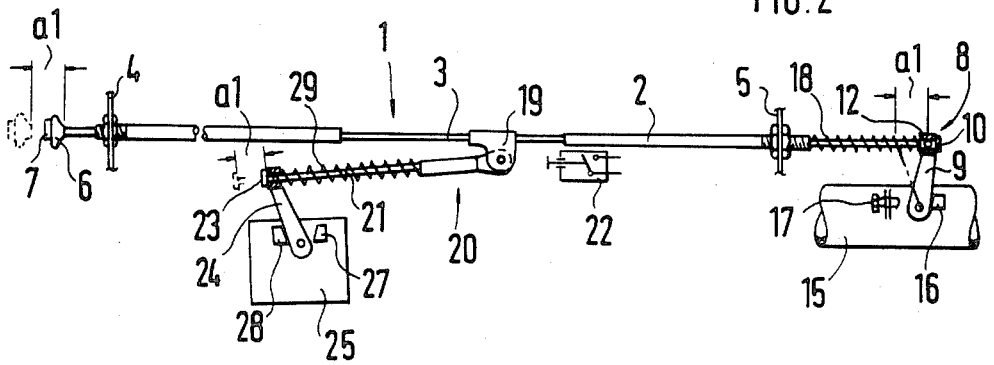
Figure 3:
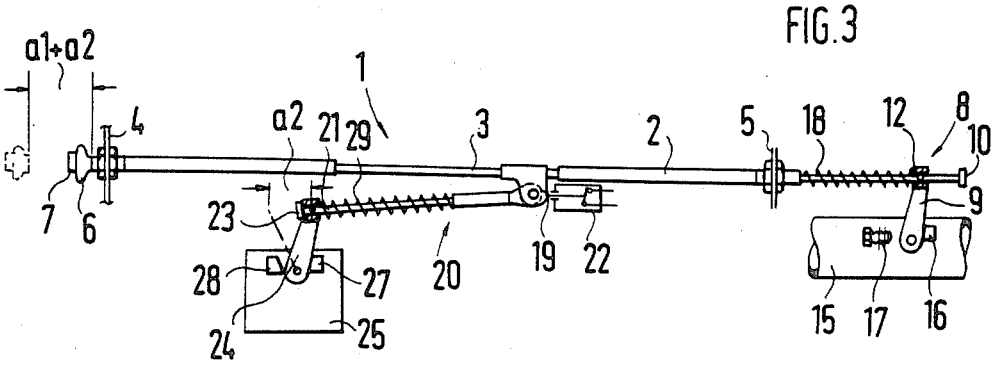

A commercially available adjusting cable is provided as a connecting rod 1 and includes a two part cable housing or casing 2 and a metallic cable core 3 longitudinally guided in the cable housing 2. The cable housing 2 is held at fixedly disposed attachment plates 4 and 5 by means of counter-nuts at respective opposite sides of said plates. At one end of the cable core 3 a control knob 6 is fastened, in which knob 6 a blocking knob 7 is centrally arranged. The other end of the cable core 3 protrudes through a connecting pivot joint 8 that is arranged at a one-armed throttle valve lever 9 and is provided with an abutment ring 10 which in the FIG. 1 illustrated position of the adjusting device abuts at the facing surface 11 of the connecting pivot joint 8. The connecting pivot joint 8 is formed with a guiding casing 12 having an outwardly protruding pin 13 engageable in a bore of the throttle valve lever 9. At its other end the throttle valve lever 9 is fastened at the shaft of a throttle valve 14 which is bearingly supported in the suction or intake pipe 15 of a reciprocating piston combustion motor. The pivotable movement of the throttle valve lever 9 is limited by means of a right-hand disposed abutment 16 and a left-hand adjustable abutment 17. Between the guiding housing or casing 12 of the connecting pivot joint 8 and the facing surface of the cable casing 2 there is disposed a helical spring 18 under pretensioning.

Approximately in the middle of its longitudinal extension, a connecting piece 19 is fixedly clamped to the cable core 3, at which connecting piece 19 a carrier rod 20 is connected and disposed to extend at a sharp angle. The carrier rod 20 exhibits a pin 20 which is provided in its forward region with an abutment ring 23 and which protrudes through the connecting pivot joint 26 arranged at the adjusting lever 24 of a propeller regulator 25. The pivotable movement of the adjusting lever 24 is limited by means of a right-hand abutment 27 and a left-hand abutment 28. A prestressed spiral spring 29 is disposed between the carrier rod 20 and the push rotation linkage 26 of the adjusting lever 24.

When the blocking knob or button 7 is pushed into the control knob 6, the blocking device 30 is disconnected. A now freely movable cable core 3 will be moved toward the right by means of the supporting helical spring 18 acting at the fixedly disposed cable casing 2 as well as by means of the strength of the helical spring 29. The maximum pushing movement, respectively the angular path "al", of the throttle valve lever 9 is limited by means of the right-hand abutment 16 of this throttle valve lever 9. When in this position, the throttle valve 14 is fully opened and the motor rotational speed is approximately 2300 revolutions per minute. The abutment ring 23 of the carrier rod 20 abuts at the connecting pivot joint 26 of the adjusting lever 24. Both spiral springs 18 and 29 have been substantially unstressed during this first shoving movement "al". Upon further forward or rightward pushing of the control knob 6 only friction forces at the junction of the cable core and joint 12 occur without anymore effective movement of lever 9.

If the pushing knob 6 is pushed further toward the right along the path "a2", the adjusting lever 24 is pivoted by corresponding angular movement until it comes to abutment on the right-hand abutment. During this pivotable movement the propeller pitch of the propellers are adjusted by means of the propeller controller 25 hydraulically from maximal to minimal pitch. The thereby increasing torque of the propellers correspondingly increases the motor operation and its rotational speed increases to approximately 5000 revolutions per minute.

Shortly before reaching the right-hand abutment 27 an end switch 22 is closed by the connecting piece 19 by means of which an injection device of the motor is switch toward increased fuel enrichment. The motor operation thereby increases to its highest value which is approximately with a motor speed of 5300 revolutions per minute.

Figure 4:
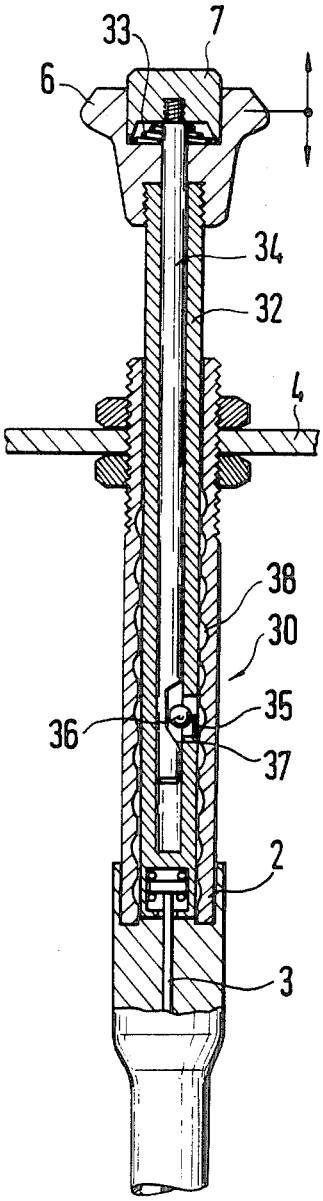
FIG. 4 is an enlarged schematic part-sectional view which shows the adjusting cable with the blocking device used in the device of FIGS. 1–3.

The FIG. 4 enlarged illustration of the adjusting cable shows a disconnected blocking device 30 in the position shown. A guide tube 32 is conformed to and provided in the inside of the fixedly disposed cable casing 2 and the control knob 6 is threadably attached to this guide tube 32. A blocking knob 7 is longitudinally guided against the strength of a spring 33 centrally in the switching knob 6 (here shown in the pushed-in position) and is secured against falling out. A blocking rod 34 is threadably connected to the blocking knob 7, which blocking rod 34 conforms to and is disposed inside of the guide tube 32 and includes a sloped receptable opening for receipt of a blocking ball 36 which is biased by a leaf spring 35. When one releases the blocking knob 7, the blocking ball 36 will be shoved against the sloped surface 37 of the receptable through a breakthrough of the guide tube 32 in a winding of a thread-path of the cumferential windings 38 of the cable casing 2. Thereby the guide tube 32 and the cable core 3 fixingly connected thereto are blocked against longitudinal sliding movement. It is furthermore possible to utilize a rotational movement of the switching knob 6 for fine adjustment of the cable core 3 and the activating members connected thereto.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. Adjusting apparatus for an airplane propulsion system of the type having a reciprocating piston combustion engine with an adjustable intake throttle valve and with a propeller pitch regulator; the improvement comprising: a throttle valve, a propeller pitch regulator, said adjusting apparatus comprising:

movable connecting rod means linked to the throttle valve via a pivot joint means and movably guided in and with respect to a relatively fixed rod casing means, throttle valve spring means fixed to the rod casing means and biasing the connecting rod pivot joint means toward an open throttle position, manually releasable blocking means for selectively blocking movement of the connecting rod means with respect to the fixed rod casing means, and carrying rod means connected to the connecting rod means and a control member of the propeller pitch regulator via the interposition of a pitch regulator spring means therebetween.

2. Apparatus according to claim 1, wherein the connecting rod means is formed as an adjusting cable core movably guided in the rod casing means.

3. Apparatus according to claim 2, wherein an end of the connecting rod means is linked to the throttle valve by a pivot joint means having an abutment ring, the carrier rod means connected to the control member of the pitch regulator through a pivot joint means having another abutment ring, the respective connecting pivot joints being arranged respectively at a throttle valve lever connected to the throttle valve and a pitch adjusting lever of the propeller pitch regulator.

4. Apparatus according to claim 3, wherein both pivot joints comprise a guiding casing means and outwardly protruding pins for gripping into respective bores of the throttle valve lever and a protrusion on the pitch adjusting lever.

5. Apparatus according to claim 3, wherein left and right abutments limit movement of the pitch adjusting lever and of the throttle valve lever.

6. Apparatus according to claim 3, wherein the throttle valve lever and the pitch adjusting lever are disposed approximately perpendicular to the connecting rod means when in their middle pivoting position.

7. Apparatus according to claim 3, wherein the throttle valve spring means and the pitch regulator spring means are spiral springs in a pretension condition and disposed between facing side means on the cable casing, and the carrying rod means and the connecting pivot joints respectfully.

8. Apparatus according to claim 3, wherein there is a one to one co-correspondence between movement of the connecting rod means and the connecting pivot joint of the throttle adjusting lever between closing and opening of the throttle valve.

9. Apparatus according to claim 3, wherein an end switch is activated by the connecting rod means at an end of its maximum movement, which end switch effects a fuel enrichment in the fuel air mixture of the motor to operate the motor at its maximum operating condition.

10. Apparatus according to claim 4, wherein left and right abutments means limit the movement of the pitch adjusting lever and of the throttle valve lever.

11. Apparatus according to claim 10, wherein the throttle valve lever and the pitch adjusting lever are disposed approximately perpendicular to the connection rod means when in their middle pivoting position.

12. Apparatus according to claim 1, wherein the throttle valve spring means and the pitch regulator spring means are prestressed spiral springs; the valve spring means disposed between side of the cable casing and the throttle valve and the pitch spring means disposed between the connecting rod and propeller pitch regulator.

13. Apparatus according to claim 12, wherein there is a one to one co-correspondence between movement of the connecting rod means and the connecting pivot joint of the throttle adjusting lever between closing and opening of the throttle valve.

14. Apparatus according to claim 13, wherein an end switch is activated by the connecting rod means at an end of its maximum movement, which end switch effects a fuel enrichment in the fuel air mixture of the motor to operate the motor at its maximum operating condition.

* * * * *